US008448552B2

(12) United States Patent
Hoffman

(10) Patent No.: US 8,448,552 B2
(45) Date of Patent: May 28, 2013

(54) CUTTING GUIDE BOARD

(76) Inventor: William Andrew Hoffman, Ridgewood, NJ (US)

( * ) Notice: Subject to any disclaimer, the term of this patent is extended or adjusted under 35 U.S.C. 154(b) by 330 days.

(21) Appl. No.: 13/034,665

(22) Filed: Feb. 24, 2011

(65) Prior Publication Data

US 2012/0216660 A1 Aug. 30, 2012

(51) Int. Cl.
*B26D 7/01* (2006.01)

(52) U.S. Cl.
USPC ..... 83/13; 83/466.1; 83/451; 30/165

(58) Field of Classification Search
USPC 83/466.1, 597, 599, 651, 13; 99/537; 30/501, 30/502, 303, 299, 165, 279.6, 304; D7/672–677
See application file for complete search history.

(56) References Cited

U.S. PATENT DOCUMENTS

| | | | | | |
|---|---|---|---|---|---|
| 486,917 | A | * | 11/1892 | Walker | 225/103 |
| 1,703,154 | A | * | 2/1929 | Lanzkron | 83/762 |
| 1,753,371 | A | * | 4/1930 | Georgopoulos | 83/466.1 |
| 1,864,147 | A | * | 6/1932 | Rantine | 30/303 |
| 2,073,257 | A | * | 3/1937 | Van Riper | 83/581.1 |
| 2,173,038 | A | * | 9/1939 | Hartman | 83/806 |
| 2,458,090 | A | * | 1/1949 | Miller | 30/142 |
| 2,520,000 | A | * | 8/1950 | Dettman | 83/879 |
| 2,592,657 | A | * | 4/1952 | Cierley | 83/543 |
| 3,095,603 | A | * | 7/1963 | May | 452/30 |
| 3,116,770 | A | * | 1/1964 | Tanuma | 30/114 |
| 3,257,725 | A | * | 6/1966 | Dignard | 30/290 |
| 3,315,591 | A | * | 4/1967 | Elliott | 99/421 R |
| 4,964,323 | A | * | 10/1990 | Fortney | 83/167 |
| 4,976,029 | A | * | 12/1990 | Kennedy | 30/114 |
| D318,601 | S | * | 7/1991 | Barnett | D7/673 |
| 5,499,578 | A | * | 3/1996 | Payne | 99/537 |
| 5,653,154 | A | * | 8/1997 | Liu et al. | 83/762 |
| 5,664,474 | A | * | 9/1997 | Punt | 83/761 |
| 5,823,079 | A | * | 10/1998 | Liu et al. | 83/13 |
| 5,907,989 | A | * | 6/1999 | Sie et al. | 83/762 |
| D429,972 | S | * | 8/2000 | Wang et al. | D7/667 |
| 6,451,262 | B1 | * | 9/2002 | Chiodo | 422/536 |
| 7,065,880 | B2 | * | 6/2006 | Howman et al. | 30/114 |
| 7,249,550 | B1 | * | 7/2007 | Thune, Jr. | 83/599 |
| 7,428,860 | B2 | * | 9/2008 | Vagnby | 83/651.1 |
| 7,617,753 | B2 | * | 11/2009 | Bouton et al. | 83/167 |
| 7,730,818 | B1 | * | 6/2010 | Kannegieter | 83/597 |
| 7,857,687 | B2 | * | 12/2010 | Gagliardi, Jr. | 452/174 |
| D635,409 | S | * | 4/2011 | Coffey | D7/674 |
| D647,366 | S | * | 10/2011 | Enghard | D7/412 |
| 8,122,804 | B2 | * | 2/2012 | Noguchi et al. | 83/607 |
| D664,013 | S | * | 7/2012 | Nguyen | D7/674 |
| 8,241,688 | B2 | * | 8/2012 | Aguirre | 426/518 |
| 8,272,631 | B2 | * | 9/2012 | Gannon | 269/90 |

(Continued)

*Primary Examiner* — Sean Michalski

(57) ABSTRACT

A cutting guide, and a method for slicing a solid, cuttable workpiece such as vegetables, meat and other items in said cutting guide, comprising a plurality of flights of a coiled material defining an end, a midsection and an opposite end, having an overall length determined by the number and gauge of said flights longitudinally to the major axis of said plurality of flights and any gap there between, that is held in a polymer base having mortises in said polymer base surface, that defines an interior region into which a workpiece may be placed, and an exterior affording access to said interior and any workpiece disposed therein for a knife or other cutting tool, via said gaps between said flights, to enable said workpiece to be cut into or cut through by said knife or cutting tool, transverse to said length or major axis.

13 Claims, 4 Drawing Sheets

U.S. PATENT DOCUMENTS

2002/0100173 A1* 8/2002 Suer et al. ..... 30/114
2003/0079350 A1* 5/2003 Howman et al. ..... 30/114
2004/0016131 A1* 1/2004 Hayashi ..... 30/302
2004/0025651 A1* 2/2004 Bachman et al. ..... 83/13
2008/0250943 A1* 10/2008 Malandain et al. ..... 99/537
2010/0175568 A1* 7/2010 Fritz-Jung et al. ..... 99/537
2012/0297991 A1* 11/2012 Hueser ..... 99/547

* cited by examiner

CUTTING GUIDE BOARD

FIELD

The present invention relates to an apparatus and method for manually cutting workpieces, particularly food items, of an initial length into pieces of shorter controlled length.

BACKGROUND OF THE INVENTION INCLUDING PRIOR ART

The simplest example of a guide of prior art is a miter box, a three-faced construction with a bottom, and two sides vertical to the bottom and parallel to each other, said sides having opposing slots into which a cutting tool is inserted. A workpiece is placed on the bottom, between said sides and said slots, and held in place while the cutting tool is laid in said slots and used to make the cut. Each separate cut requires a measurement and moving the workpiece to the slots.

Controlling lengths of cut-off pieces is also achieved by fixed-blade tools, for example, vegetable cutters enable a workpiece to be advanced along a surface to impact the leading edge of a blade situated somewhat above the surface, leaving the cut-off piece to pass below the blade and the remaining workpiece to pass over. Repeating the operation in the same direction reduces the workpiece to a series of shorter pieces ("slices"). Multiple examples exist in the patent literature; U.S. Pat. No. 7,690,285 B2 is one such in a long list of generally similar design.

Other cutting guides, commercially available may be recognized as a set of "fingers", with controlled spacing and general control of the width of the fingers themselves, such as a modified fork, or a modification of salad tongs. In the former case, the fork is inserted into a workpiece and the cutting tool, a knife, inserted between the tines, the handle and the workpiece can be used to slice through the workpiece, for example, a potato. The modified salad tongs are hinged devices in which both clasping portions have slots (whereas most salad tongs have a fork on one side and a spoon on the other); the handles are opened, then closed around a vegetable such as a tomato and cuts made by a knife wielded as for the simple fork just described. The disadvantage of simple fork lacks left-right control for the knife and pieces are easily cut into wedges or other irregular pieces, and knife thrust insertion is inconvenient. A disadvantage of the hinged clasping tool is that it has the same insertion requirement, a similar awkwardness to the vertical handle and adds the need to control both compression and angular motion during cutting. Regular slices are somewhat easier than with the simple fork, but the squeezing force can easily damage some of the slices as well as the remainder of the workpiece.

Each of the above means has specific limitations or disadvantages that afford opportunity for invention. For instance, the mitre-box design requires a separate movement of the work and measurement as noted above, and affords little advantage over simply cutting a vegetable on a cutting board in the usual way. The frame with blade implement has the advantage of simplicity in movement, but the thickness is a matter of some bother to adjust, any vegetable to be sliced is done one piece at a time, the blade is not sharpened so easily as a typical kitchen knife and multiple patents are known whose primary purpose is to reduce the safety issue of sliding a workpiece by hand into the sharp edge of a blade. The clasping implements have problems with crushing the vegetable to be cut, and are often limited to a single or a very small number of different fruits or vegetables and are not generally useful. The above described extended tine fork lacks left-right (yaw) control and slices can easily be wedges, instead of generally uniform slices.

The typical cutting implement includes a blade of some sort, and the Class for Cutting is 083, wherein are found a multitude of devices for mechanized cutting, and cross-references to manual cutters of the frame-with-blade type mentioned earlier. Class 30 covers Cutlery, and several implements are referenced first in that class, including a device described in Published U.S. App 2004/0016131 (Hayashi).

This latter implement consists of a series of parallel guide ribs curving from one edge of a generally circular base to an opposing point on the same base, the guide ribs serving to control a knife's movement through a vegetable to achieve uniform slices. In overview, it is recognizably an improvement on a mitre box, in which a series of slots allow a piece placed under the bowl-shaped guide to be cut uniformly. A disadvantage is that it does not handle irregular vegetables, indeed will not work with many different types of vegetables and is primarily a precision cutter of small dice-shaped pieces from single prepared segments of certain solid vegetables, such as potatoes.

Hayashi attempts to solve part of his stress-raiser problem, as well as the complementary blade-damage problem arising from the knife's impacting his support ring, by using a round cutting board that fits inside the guide's main support ring. The overall effect is of a cap of parallel guide segments placed over a board upon which has been placed a prepared vegetable piece to be further cut. Making multiple slices that leave such slices abutting each other and without relative movement, with an actual knife, as contemplated in the use of Hiyashi's unit, seems exceptionally tedious, further limiting the value for general use.

In light of the foregoing discussion, with their limitations, defects and disadvantages it remains valuable to overcome the defects noted and to provide a cutting guide enabling a plurality of cuts to be made in a broad range of workpieces, including multiple workpieces in a single manual operation, with improved restraint and stability of said workpieces, affording additional control of cut length and uniformity.

The objects, advantages and features of the present invention are readily apparent from the following description of the preferred embodiment(s) for carrying out the invention.

SUMMARY OF THE INVENTION

I have invented a cutting guide that comprises a coil and a cutting board base with recesses, said coil comprising one or more turns defining an interior region and an exterior region with two ends, one end opened and the other end closed with said coil end having coils of decreasing diameter, and a midsection, said midsection being placed in said cutting board recesses and having the length determined by the number of said flights, their dimensions and spacing. Meats, fruit and vegetables are inserted in said open end and readily sliced with a knife guided between said coils and pressed through the item being cut. In the present invention an advantage is that the knife is prevented from meeting the interior of any coil flight and cannot be dulled by such contact and the meat, fruit or vegetable is cut completely through.

Relative to other manual guide devices discussed under prior art, the advantages of my invention are that spacing of the guide members is set by the pitch of the spring component, a result of a winding method that readily uses stainless steel, a preferred material of construction. The combined effect is that this invention is both less expensive and more durable than that of Hayashi. Its open-ended construction, shown in more detail in the drawings, allows a far greater range of vegetables to be handled by a single unit, and even allows for multiple vegetables to be inserted and cut in a single operation. The advantage of being able to accept multiple types and sizes of fruits or vegetables exists in comparison with the other guides as well, in addition to the greater control initially stated as an objective, and there are advantages even over the blade/frame devices, in that multiple lengths of vegetables (carrots, celery, etc.) can be inserted and cut in one step, length changes are immediately realizable by simply selecting a gap suitably distant from an end or a previous cut, and the movement of the knife is familiar, safer than a blade that may be obscured by the fingers holding a piece of vegetable on a sliding frame, and by limiting motion, safer than a knife free to move in unintended directions as by slipping.

Another advantage is that embedding the guide coils in the cutting board base also keeps the guide from being damaged by the knife, and the knife edge from being dulled by contact with the coil, holds the length of the guide coils in fixed position at the bottom of the cut, and allows a slight flexing to distribute bending forces over the coils on both sides of the knife during cutting, eliminating stress raisers. A similar-appearing set of parallel rings embedded or recessed into a cutting board would have little resistance to tipping of each ring (there being no connection one to another), and each ring would need to be held by the user during each cut, which is not the case for the present invention.

DETAILED DESCRIPTION OF THE INVENTION

Figure 1:
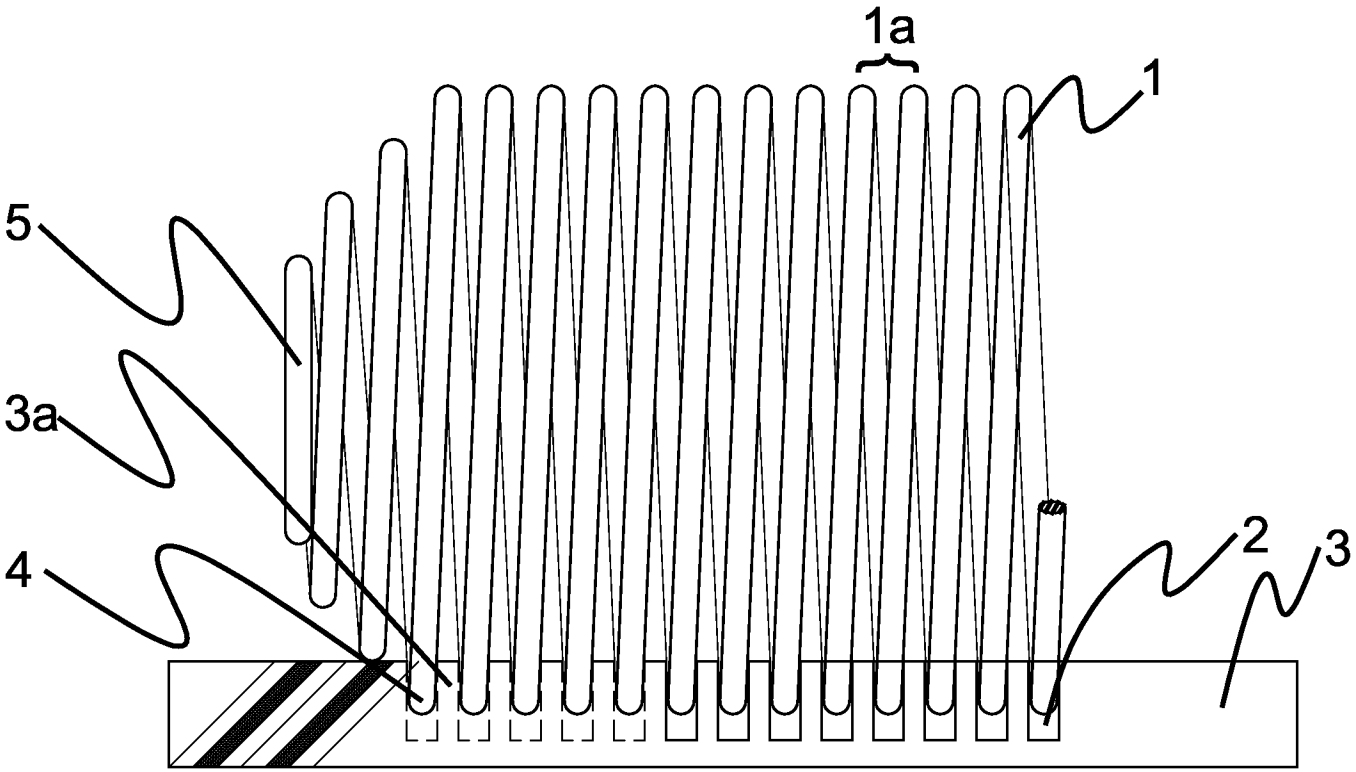
FIG. 1 is a side elevation view of a basic embodiment of the current invention in use

The disadvantages of prior art were presented in the Background section fall into two areas relating to the tool controlling spaces of a guide: single-gap guides (e.g., mitre boxes) require the workpiece to be moved, and existing multi-gap guides (e.g., modified forks) lack transverse angle control among many other things.

The present invention enables a plurality of gaps, so the workpiece need not be moved while cuts are made, and said gaps are disposed to directly control transverse cutting, and thereby overcome the major faults of prior art. That it also overcomes on other teaching (viz., Hayashi) and adds other advantages that will become clear in the course of this description.

A guide might be created from an open frame of several designs by the simple expedient of holding the frame while opposite sides are cut vertically by some means. The height of said sides limits the size of any workpiece, since it will not engage a blade of an overheight piece until said piece is partially cut, and generally the piece should be noticeably below the top of any frame to ensure proper guiding.

The limitation of workpiece size relative to frame height just mentioned could be at least partially overcome by folding opposing frame edges with gaps over until one side met another, creating a tunnel with gaps. Workpieces could be inserted in the length of the tunnel or tube thus formed and cut using the gaps to guide a knife. This would amount to an open version of the dome-with-gaps of Hayashi's teaching, and suffer the same limitations discussed in the section on prior art: high stress loading in the groin between bases of opposing frame components being an important one. Eliminating the groin by ganging a set of rings will not serve; with no ring-ring support, their guide value is small to nil whereas such support creates the very groin stress raiser just mentioned.

A coil avoids these limitations and disadvantages. The gap in a coil design is defined by its pitch (and the gauge of the wire or ribbon used to make the coil), and the bending stress is distributed instead of concentrating in a groin between tunnel elements since these are absent. The pitch also affects the angle at which a cutting action takes place, but for small values, a cut is near enough to orthogonal to the main axis as to make no difference where the workpiece is a food (e.g., a vegetable).

A blade passing between any pair of coils of a plurality of coils is generally able to reach the inside surface of the coil element connecting said pair. It might seem that this, then, was an ideal guide, if the coil could be modified so that it did not roll. A variety of means were examined including attached small rings for screws, attached pins for insertion into receiving holes and several others, all of which meant that the coil was not a standalone item, but would need to be fastened to some sort of surface to hold it still enough for one-handed cutting. As these methods were examined, it became clear that the coil was not generally useful for cutting, despite the ability for a blade to reach the opposite side. Indeed, one limitation was that reaching the opposite side of the "tube" formed by a uniform coil meant that either the blade or the coil would be damaged. But the effect that was unexpected was that cutting was often incomplete.

The solution to the problem of incomplete cutting was to embed a plurality of coils in a matrix, so that said matrix protruded between pairs of coils. This can be done by disposing said plurality of coils into a melt of a plastic and allowing said plastic to cool and it can be done by creating a plurality of grooves or mortises into which the aforementioned plurality of coils may be inserted. The latter approach is preferred for reasons that will become clear.

FIG. 1 shows a side elevation view of a plurality of coils (1) of pitch (1*a*) inserted into a plurality of mortises (2) in a preformed cutting board (3), so that there is a distinct element of each coil below the surface of said cutting board (4), and leaving a "land" of cutting board (3*a*) protruding between pairs of coils. A knife, introduced between such pairs will then pass through the space enclosed by the plurality of coils and any workpiece (e.g., vegetable) therein, and reach a firm surface (the "land", (3*a*)), completing the cutting or slicing. Coil part (5) shows a reduced radius coil that serves to restrain pieces to be cut, while said pieces are inserted into the plurality of coils from the opposite end.

Figure 2:
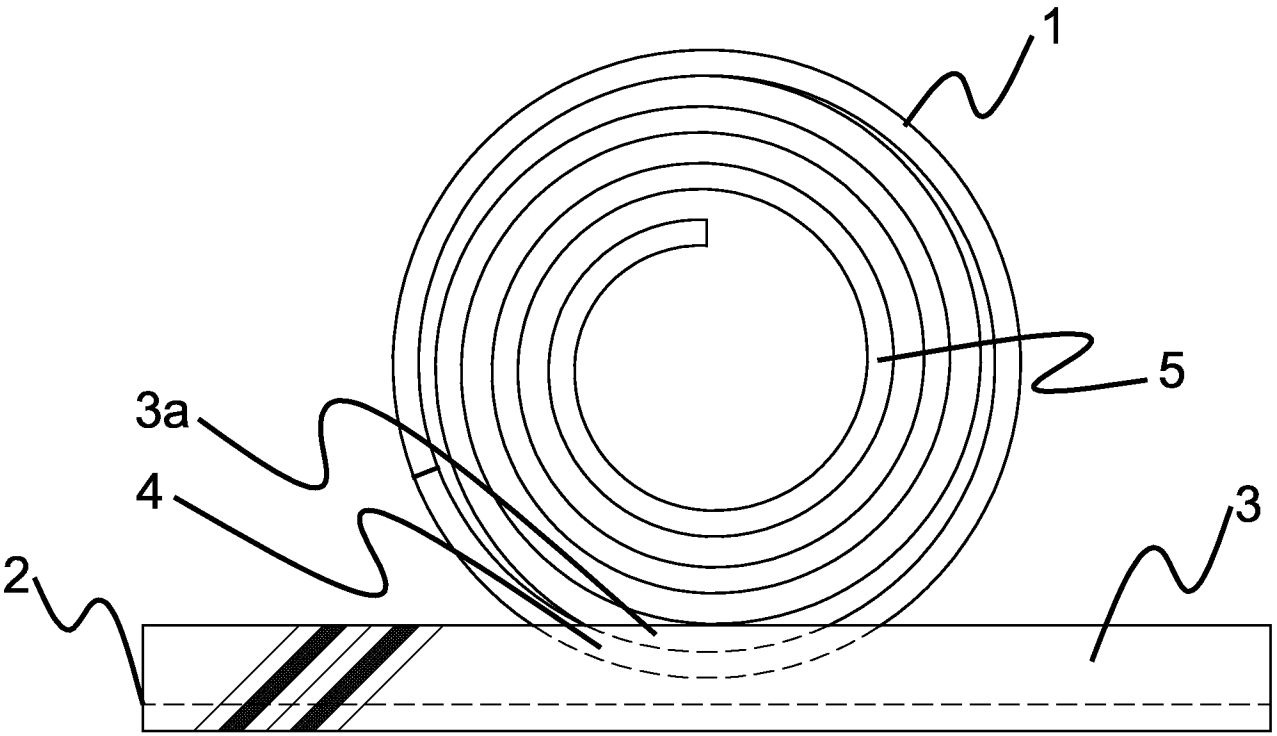
FIG. 2 is a right side elevation view of the basic structure of the current invention

FIG. 2 shows a right end elevation view of the current invention illustrating the insertion of coils such that a "land" is formed between coils and the enumeration is as for FIG. 1 (pitch, (1*a*) is not visible from an end view).

At the limit, the cutting board base may be no more than a strip of plastic with alternating ridges and grooves, long enough to mate with the full-size coils and wide enough to provide an internal surface (3*a*), but it is preferred to have a cutting board base substantially wider than the diameter of the coil to provide stability against tipping.

Figure 3:
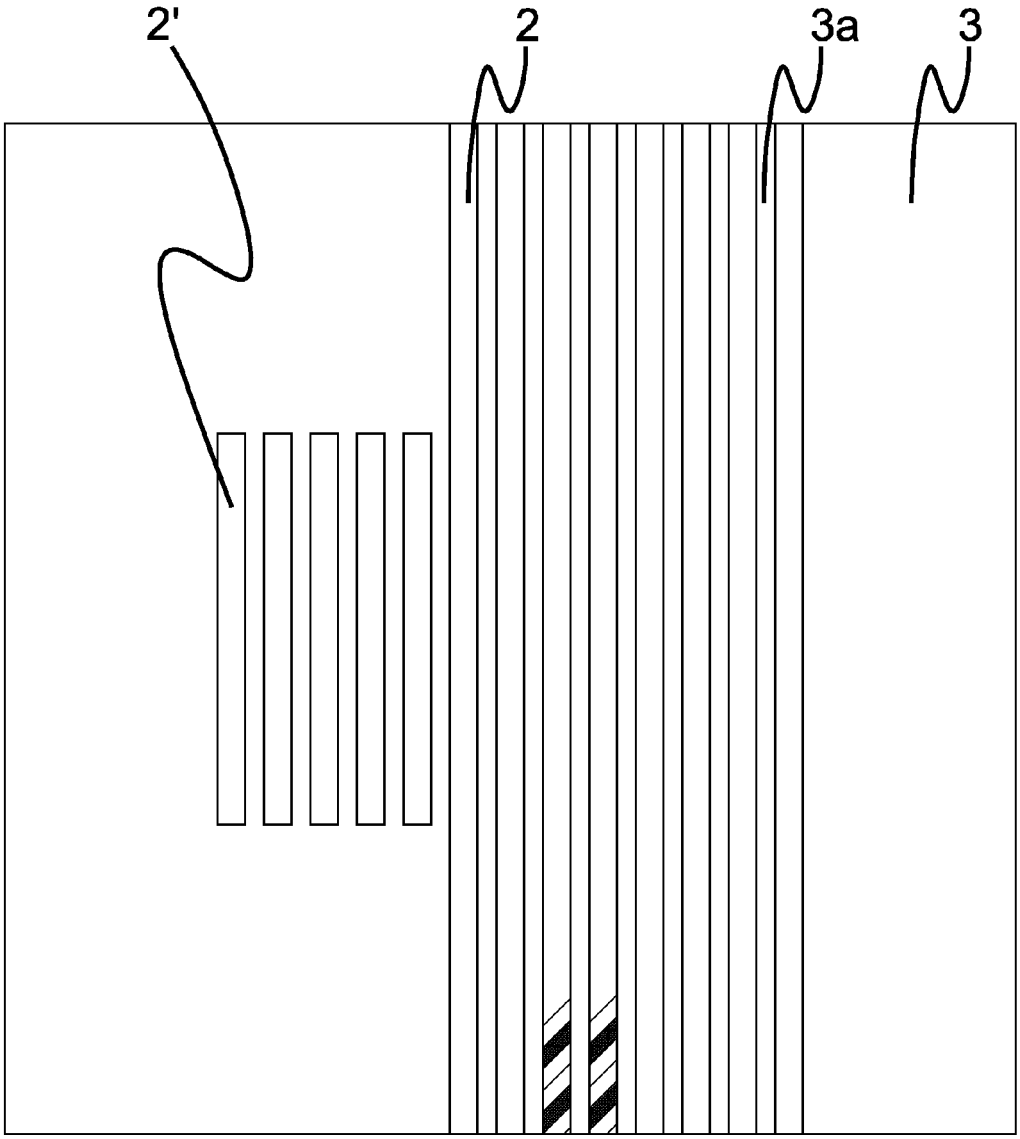
FIG. 3 is a plan view of the mortises in the board of the current invention
Figure 4:
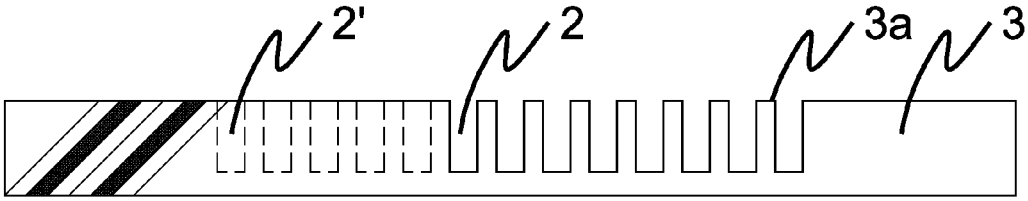
FIG. 4 is a side view of the base showing the mortises "of the current invention.

A preferred embodiment of the current invention is to have said plurality of mortises blind, as shown in FIG. 3 and FIG. 4, wherein ordinary mortises are labeled (2) and blind mortises are labeled (2'). The advantage is one of strength for a given cutting board (3) thickness, as well as tactile and appearance factors, at the expense of simplicity and cost, but as with other variations that may occur to one skilled in the art, this should not be construed as a limitation on the scope of the invention.

Figure 5:
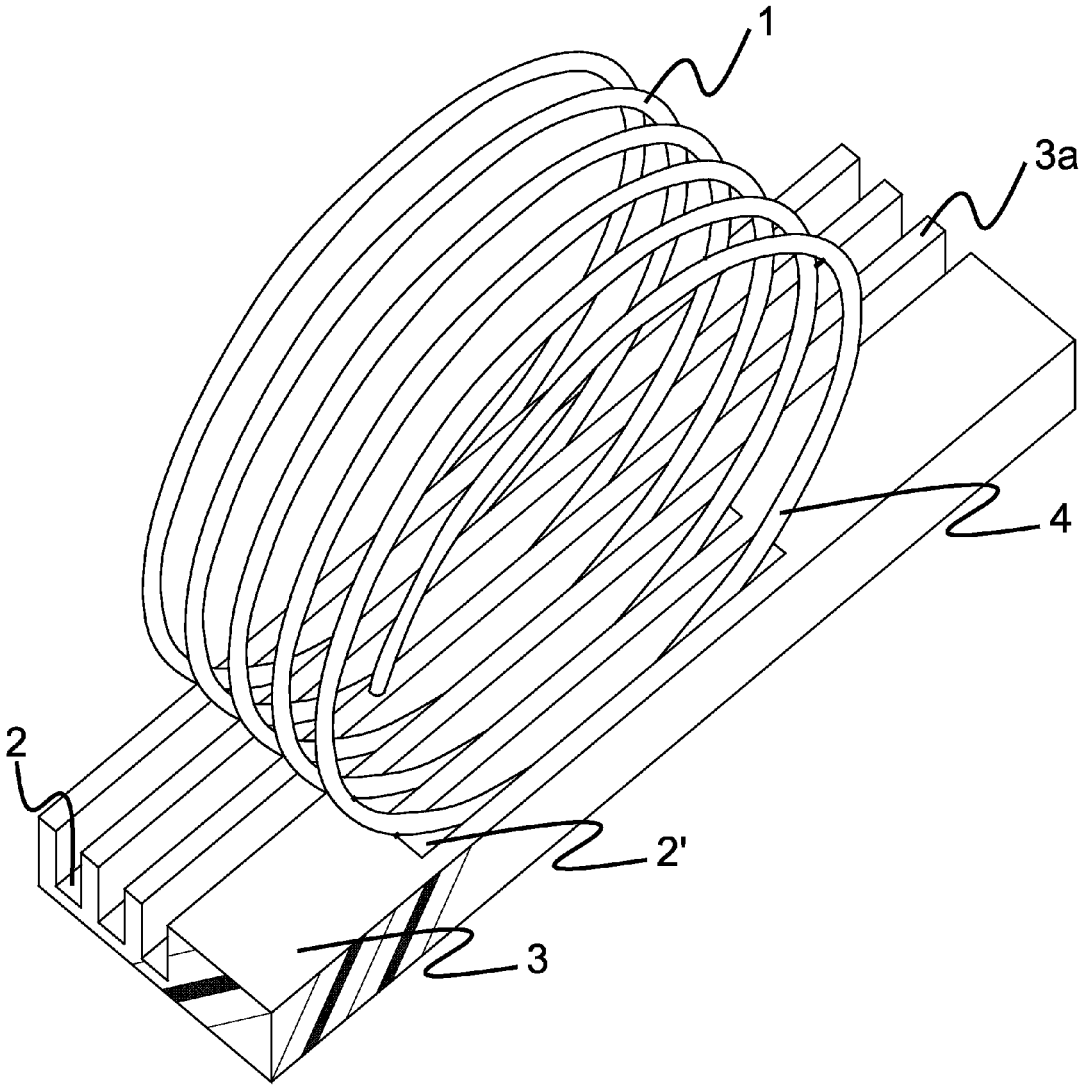
FIG. 5 is an enlarged perspective view of the current invention.

FIG. 5 provides a close up (enlarged) perspective view of several of a plurality of coils disposed into several of a plurality of mortises, and exhibiting both blind (2') and ordinary (2) mortises, as well as said "land" (3*a*) against which a knife or other bladed instrument completes its cutting or slicing.

According to the present invention, said plurality of coils fits into said plurality of mortises tightly enough that said plurality of coils resists rolling out in use, an effect believed to be due to friction between said coils and said mortises. The restraint is readily overcome, however, so that a user may pull said plurality of coils from said mortised cutting board and wash the two parts separately and completely. Moreover, should wear become significant, the parts are interchangeable so the user can obtain a replacement of the worn part while keeping the other. The advantage over a one-piece, mold-in-place unit is apparent, although overall costs may inure at some time to the latter construction.

The preferred materials of construction are largely those dictated by the preferences of the marketplace. Stainless steel (e.g., type 302) for the plurality of coils enables machine washability and is durable, while cutting boards in commerce are often made of polyolefin plastics for washability and resistance to contamination. Even so, polyesters, polyacetals and other polymers have been used to make coils and may so be used in the current construction and cutting boards of wood as well as various polymers may be mortised to accept a plurality of coils as specified herein.

The preferred coil aspect is round, as shown in FIG. 2, of overall diameter 2-8", prepared from round wire with diameter 0.01-0.25", preferably, 0.1-0.2", with a pitch of 1.5-2. Length is typically at least 1 times overall diameter, and may be up to 3 times overall diameter, with 1.5-2 typical. At least one end of any plurality of coils of the current invention is open and the full diameter of the majority of coils. Both ends may be fully open, but preferentially, one end of said plurality of coils is closed as described above and shown in FIG. 1 (5) and FIG. 2 (5) to retain the pieces inserted for cutting or slicing.

Having selected a material for the cutting board component, the general size and shape is a matter of convenience, except that the board must be thick enough to be mortised to a sufficient depth to enable the coil to be embedded at least one wire diameter deep. Although this is sufficient to protect the blade of a cutting tool, the preferred embodiment embeds each coil 2-3 wire diameters, creating a land with a length about ⅔ the overall coil diameter of a round aspect plurality of coils. This construction retains the full diameter in width and about 90% of the diameter in height. This is far superior to the notched dome described by Hayashi, which loses over half its diameter in height.

EXAMPLE

A 0.135" OD type 302 stainless steel wire was wound to a 3.27" OD (3" ID) plurality of coils with a pitch of 2, terminating in 2 reduced-diameter coils with a final OD of 1". A high density polyethylene (HDPE) cutting board base, 0.5" thick and 6×6" nominal, with 14 blind mortises 0.375" deep and 2" long centered therein, allowing the described plurality of coils to be embedded about 2.5 diameters, leaving lands about 2" long inside the plurality of coils. The full inside diameter (ID, 3") was available for inserting workpieces, and the land-to-inside top was about 2.7" or 90% of the original ID. Blind mortises were vital; fourteen full mortises 0.375" deep would have resulted in a 0.5" board with unacceptable flexibility, unable to retain the plurality of coils.

Wire gauge is in the range of blade widths for kitchen knives, with a pitch that leaves a space about the width of such blades. In addition, one wants to cut thin slices if possible. For typical kitchen knives, wire gauges of 0.1-0.2", with gaps 0.1-0.2" are suitable, with 0.125-0.175 for both preferable. It is not necessary that the wire and the gap widths be the same. For the most part, a cut amounts to a single pass between the coils, so the cut piece is roughly the width of the coil (wire). Larger or smaller gauge wire, with corresponding gaps can be used. There is no particular advantage to a large gauge wire with a small gap, for example, since the smaller gauge/gap already allows thin slices, and by using alternate gaps, double (triple, etc.) thickness slices.

Thick wire with wide gaps could be used, however, with heavy knives (cleavers), or, with a slender knife, used to cut to the left of one coil and the right of the adjacent (i.e., two cuts in one gap), and the heavier gauge also permits larger overall diameter coils, perhaps up to 10" in diameter. Such coils (say, with 0.25" or larger wire) would suffer from overall inconvenient weight if made from steel.

Thin wire coils might be used with flensing knives or with cheese wire-type cutters, but will still be limited to not much smaller than for the standard knives because even spring-steel will flex too much for controlled cuts, particularly if the overall coil is larger than, say 2" in diameter.

With these things/thoughts in mind, the general statement of ranges comes to [for coils] 2"-10" in diameter, with wire gauges 0.05-0.3", gaps 0.05-0.3". Those to be used with narrowest knives/wire blades (preferably 2"-3" diameter; 0.05-0.12"wire/gap); standard knives (preferably 2.5-4" diameter; 0.1-0.15" wire/gap); heavy knives/cleavers (preferably 2.5-8" diameter; 0.2-0.3" wire/gap). Any one of the guides might be used with a narrower blade for special effects. In most cases, the coil is embedded in a cutting material/board with a "reveal" of said board between the coils; it is less necessary with wire bladed cutters (like a coping saw with wire), but still preferred. On the other end of the scale, a large coil of heavier gauge wire can be recognized as appropriately protected by an insert, although it should probably still be held in a depressed region of a work surface to keep it from rolling.

Alternate embodiments of practicing the invention but within the spirit thereof will, in light of the disclosure, occur to persons skilled in the art. It is intended that this description be taken as illustrative only and not construed in any sense except by the following claims.

I claim:

1. A cutting guide comprising a plurality of flights of a coiled material defining an end, a midsection and an opposite end, having an overall length determined by the number and gauge of said flights longitudinally to the major axis of said plurality of flights and any gap there between, held in a polymer or wooden base having a plurality of mortises in said polymer or wooden base surface, defined by an interior region into which a workpiece is placed, and an exterior affording access to said interior and any workpiece disposed therein for a cutting tool, placed between said gaps between said flights, to enable said workpiece to be cut through by said cutting tool, transverse to said length or major axis.

2. A cutting guide according to claim 1 wherein said solid base is polymeric.

3. A cutting guide according to claim 1 wherein said solid base is wood.

4. A cutting guide according to claim 1 wherein said coiled material is stainless steel.

5. A cutting guide according to claim 1 wherein said coiled material is a polymer selected from the group consisting of a polyolefin, a polyester, a polyacetal or nylon.

6. A cutting guide according to claim 1 wherein said plurality of flights of coiled material is held in said polymer base by means of friction between it and a plurality of mortises.

7. A cutting guide according to claim 2, wherein said plurality of coils is held in a solidified mass of said polymeric base.

8. A cutting guide comprising at least 2 uniform flights of diameter (from 2 to 10") flights of a coiled, round stainless steel wire from 0.1-0.25" diameter, defined by an end, a midsection and an opposite end, having an overall length determined by the number and gauge of said flights longitudinal to the major axis of said plurality of flights and said gap therebetween held in a solid polyolefin base of approximately the overall length and width of said plurality of coils and more than 2 wire diameters thick, having mating mortises in said polymer base surface, defining an interior region into which a workpiece is placed, and an exterior affording access to said interior and any workpiece disposed therein for a cutting tool, placed in said gaps between said flights, to enable said workpiece to be cut through by said cutting tool, transverse to said length or major axis.

9. A cutting guide according to claim 8 wherein both ends have the same diameter and said uniform diameter of flights of coils is fed workpieces from either end.

10. A cutting guide according to claim 8 wherein one end is in the shape of a cone, providing entry for a workpiece from one end while blocking in said workpiece at the other end.

11. A cutting guide according to claim 8 wherein there are preferably about 5 to about 30 of said flights.

12. A cutting guide according to claim 8 wherein said overall length is about 1 to about 3 times the average diameter of said flights.

13. A method for slicing a solid cuttable workpiece in a coil structure cutting guide as defined in claim 1 comprising:

(i) providing a coil structure cutting guide a closed end, a midsection and an opposite open end having at least two flexible loops;

(ii) opening said open end of said coil structure cutting guide, inserting the workpiece into said coil structure cutting guide;

(iii) inserting a cutting tool between said flexible loops of said coil structure cutting guide and at the top of the workpiece;

(iv) slicing the workpiece from top to bottom of the workpiece; and (v) removing the sliced workpiece from the structure.

* * * * *